US007923661B2

(12) United States Patent
Lee

(10) Patent No.: US 7,923,661 B2
(45) Date of Patent: Apr. 12, 2011

(54) TALKING IRON

(76) Inventor: Chang Sup Lee, Boyds, MD (US)

( * ) Notice: Subject to any disclaimer, the term of this patent is extended or adjusted under 35 U.S.C. 154(b) by 888 days.

(21) Appl. No.: 11/850,574

(22) Filed: Sep. 5, 2007

(65) Prior Publication Data

US 2008/0052970 A1 Mar. 6, 2008

Related U.S. Application Data

(60) Provisional application No. 60/842,495, filed on Sep. 6, 2006.

(51) Int. Cl.
*D06F 75/00* (2006.01)
*D06F 75/02* (2006.01)

(52) U.S. Cl. ..... 219/248; 219/245; 219/249; 38/75

(58) Field of Classification Search ..... None
See application file for complete search history.

(56) References Cited

U.S. PATENT DOCUMENTS

| | | | | |
|---|---|---|---|---|
| 4,203,101 | A | 5/1980 | Towsend | |
| 4,350,860 | A * | 9/1982 | Ueda | 219/705 |
| 4,484,065 | A * | 11/1984 | Ueda | 219/492 |
| 5,120,934 | A | 6/1992 | Nakada et al. | |
| D353,246 | S | 12/1994 | Kameda | |
| 6,104,288 | A | 8/2000 | Hopkins | |
| 6,108,685 | A | 8/2000 | Kutzik et al. | |
| 6,179,682 | B1 | 1/2001 | Plain et al. | |
| 6,452,501 | B1 | 9/2002 | Tse et al. | |
| 6,883,257 | B2 | 4/2005 | Couch et al. | |
| 7,102,107 | B1 * | 9/2006 | Chapman | 219/494 |
| 2002/0014479 | A1 | 2/2002 | Jones | |
| 2006/0081588 | A1 * | 4/2006 | Bowser et al. | 219/248 |
| 2006/0207986 | A1 * | 9/2006 | Brown | 219/386 |

FOREIGN PATENT DOCUMENTS

| | | | |
|---|---|---|---|
| DE | 29716816 U1 * | 11/1997 | |
| JP | 57080129 A * | 5/1982 | |
| JP | 57124623 A * | 8/1982 | |
| JP | 08233287 A * | 9/1996 | |

* cited by examiner

*Primary Examiner* — Joseph M Pelham

(57) ABSTRACT

The present invention features an iron being adapted to guide a user through an ironing task. In some embodiments, the iron comprises a plurality of fabric selector switches, a message controller, a speaker, a temperature sensor, and a microprocessor. In some embodiments, said fabric selector switches are operatively connected as inputs to said microprocessor, said temperature sensor is operatively connected to a sole plate of the iron to measure the temperature of the sole plate, and the temperature sensor is also operatively connected as inputs to said microprocessor.

11 Claims, 3 Drawing Sheets

TALKING IRON

CROSS REFERENCE

This application claims priority to U.S. provisional application Ser. No. 60/842,495 filed Sep. 6, 2006, the specification of which is incorporated herein by reference in its entirety.

FIELD OF THE INVENTION

The present invention is directed to an iron that provides audio messages to guide or prompt a user through an ironing task.

BACKGROUND OF THE INVENTION

When ironing clothes, there is a specific temperature to use on different materials. For example, when ironing acrylic or silk, a low temperature setting must be used. When ironing wool, a medium temperature setting must be used. When ironing cotton or linen, high temperature setting must be used. Ironing a fabric that withstand high temperature with the temperature setting on low would not iron well. Ironing a fabric that does not tolerate high temperature with a high temperature setting would burn or damage the clothes. When ironing a low temperature setting fabric and a high temperature setting fabric in a session, a low temperature setting fabric must be ironed first then the higher one later.

However, people make careless mistakes and they forget the order (e.g., lower temperature setting before higher temperature setting). It is easy to make that mistake. If a person carelessly irons a low temperature fabric with the iron set on a high temperature, they burn or ruin their clothes.

Therefore, there is a need for an improved apparatus to facilitate proper ironing techniques.

SUMMARY OF THE INVENTION

The present invention features an iron being adapted to guide or prompt a user through an ironing task. In some embodiments, the iron comprises a plurality of fabric selector switches, a message controller, a speaker, a temperature sensor, and a microprocessor.

In some embodiments, said fabric selector switches are operatively connected as inputs to said microprocessor, said temperature sensor is operatively connected to a sole plate of the iron to measure the temperature of the sole plate, and the temperature sensor is also operatively connected as inputs to said microprocessor.

In some embodiments, the temperature sensor is operatively connected to a sole plate of the iron to measure the temperature of the sole plate, and the temperature sensor is also operatively connected as inputs to said microprocessor.

In some embodiments, said microprocessor configured to (a) receive input data from a fabric selector switch that is actuated (e.g., activated);

(b) generate a first and second output control signals being associated with the fabric selector switch that is actuated, wherein the first output control signal is operatively connected to said message controller, such that in response a particular fabric selector switch that is actuated a pre-recorded message is selectively reproduced by the message controller and relayed over to said speaker for broadcasting, the message recites a steam-spray instruction unique to the fabric selector switch that is actuated, and optionally the message recites a confirmation of the fabric selector switch that is actuated, wherein the second output control signal is operatively connected to a heating element that heats a sole plate of the iron to a temperature that is pre-set for a fabric selector switch that is actuated, and (c) further receive input data from the temperature sensor for the microprocessor to maintain a proper heating of the sole plate at a preset temperature for the fabric selector switch that is actuated.

In some embodiments, the microprocessor generates the first and second output control signals simultaneously. In some embodiments, the microprocessor generates the first control signal first in time, and then the second control signal. In some embodiments, the microprocessor generates the second control signal first in time, and then the first control signal.

In some embodiments, the microprocessor generates another control signal to the message controller when a particular fabric selector switch is actuated, wherein the message controller triggers the speaker to broadcast a message which prompts a user to wait until the proper sole plate temperature is reached for the particular fabric selector switch actuated. For example, such message may recite "Please wait while the iron is heating" (e.g. when a user goes from the "silk" dial to the "linen" dial) or "Please wait while the iron is cooling" (e.g. when a user goes from the "linen" dial to the "silk" dial). In some embodiments, when the proper temperature is reached for the fabric selector switch actuated then the temperature sensor relays information back to the microprocessor to stop sending the control signal to the message controller to trigger the speaker to broadcast the message prompting the user to wait for the proper temperature.

In some embodiments, turning the power switch of the iron to an on position triggers the microprocessor to send a fourth signal to the message controller, wherein the speaker plays a pre-recorded message to prompt a user to determine an appropriate selection of a fabric material from the fabric selector.

In some embodiments, turning the power switch of the iron to an on position triggers the microprocessor to send a fourth signal to the message controller, wherein the message controller triggers the speaker plays a pre-recorded message to prompt a user to determine whether there are more than one article of clothing to be ironed, and to determine an appropriate selection of a fabric material from the fabric selector.

In some embodiments, the steam-spray instruction prompts a user to apply no steam and no spray, for example when the fabric selector selects a synthetic material or a silk material for ironing.

In some embodiments, the steam-spray instruction prompts a user to apply steam and no spray, for example, when the fabric selector selects a wool material for ironing.

In some embodiments, the steam-spray instruction prompts a user to apply steam and spray, for example, when the fabric selector selects a cotton material for ironing.

In some embodiments, the steam-spray instruction prompts a user to apply high steam and high spray, for example, when the fabric selector selects a linen material for ironing.

In some embodiments, the iron has a fabric selector switch for various materials: acetate, acrylic, nylon, silk, polyester, rayon, cotton blend, wool, linen, etc. In some embodiments, the fabric selector switches are arranged on a dial. For example, a particular fabric selector switch may be actuated by turning the dial to a particular position (see FIG. 1B, showing the "silk" fabric selector switch being actuated as the "silk" on the dial is set to the arrow). The speakers can be built on any part of the iron. The speakers can be built on the inside or outside of the iron. In some embodiments, music can be programmed into the iron. In some embodiments, the name of the fabric may be written on the particular switch. In some embodiments, a switch for a particular fabric may be represented by a number (e.g., 1=acetate, 2=silk, 3=rayon, etc.). In some embodiments, the iron has a steam function.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1A:
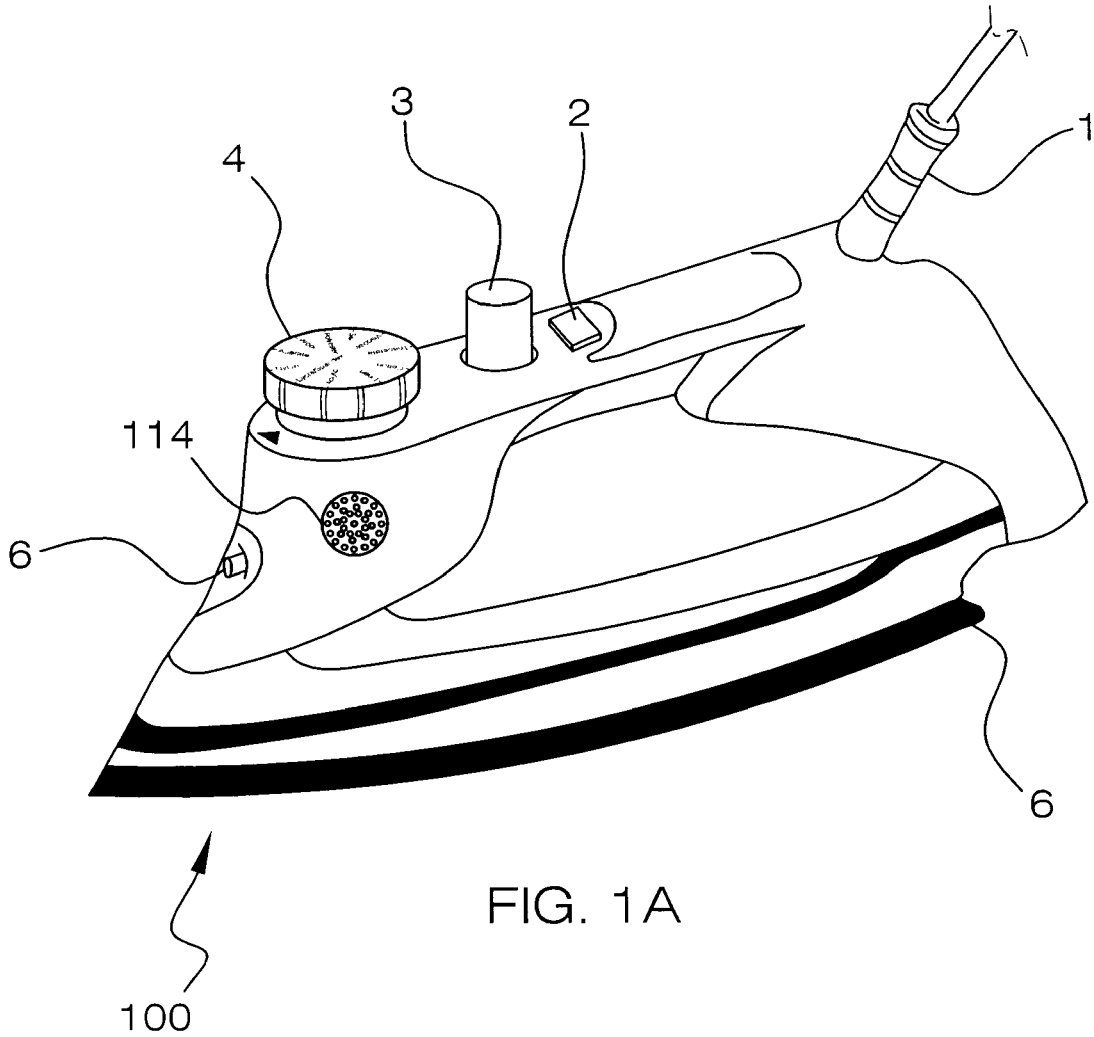
FIG. 1A shows a perspective view of a talking iron.

Referring to FIG. 1 a talking iron 100 according to the preferred embodiment of the invention is shown. The talking iron includes a power cord 1, a power light indicator 117, a spray button 3, a fabric selector 4, a speaker 114, and a sole plate.

In operation, the iron 100 is turned on and off by alternately pressing an On/Off button. When iron 100 is turned on power light indicator 117 is illuminated.

Figure 2:
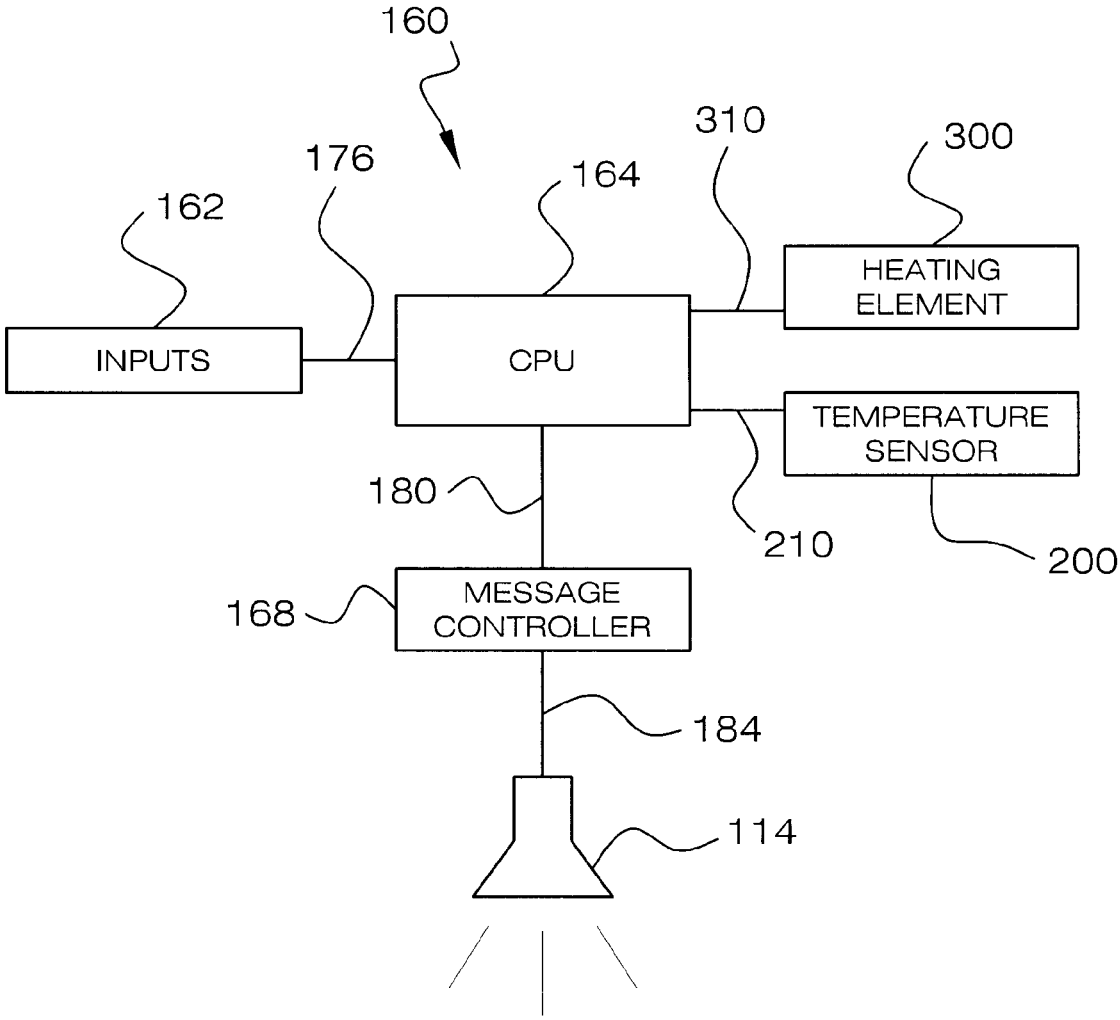
FIG. 2 shows an exemplary functional block diagram of the talking iron.

Turning to FIG. 2, a functional block diagram of the preferred embodiment of the talking iron of the present invention is shown at 160. Functionally, the iron comprises a plurality of inputs 162, a central processing unit (CPU) 164, display 118, a message controller 168, a message recorder 170, and speaker 114.

Figure 1B:
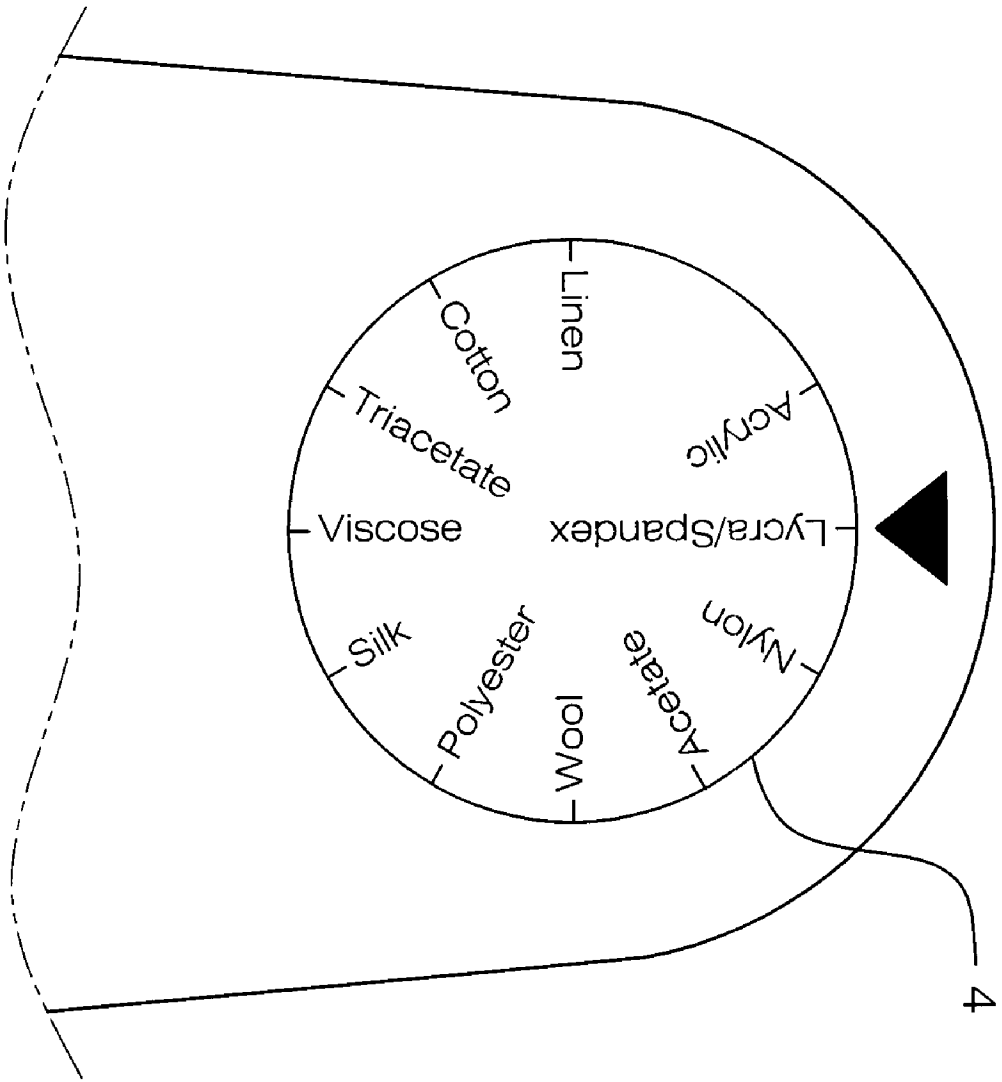
FIG. 1B shows a top view of the fabric selector switches. Each dial mode (e.g., silk, cotton, wool, linen, etc.) is a switch.

Inputs 162 comprise the a plurality of fabric selector switches 4 located on the talking iron 100 described in reference to FIG. 1. Inputs 162 are operatively connected to CPU 164 as indicated by connection 176. In some embodiments, a plurality of fabric selector switches 4 are embodied in a dial shown in FIG. 1A and FIG. 1B, and is actuated by turning the dial to a particular setting. For example, a fabric selector switch for "spandex" is actuated by turning the dial to match the word "spandex" to the marked arrow, See FIG. 1B. Other presentations for the fabric selector switches may be used in accordance with the present invention, as would be known by one of ordinary skill in the art.

The CPU 164 drives message controller 168 in response to input data received from inputs 162. The operative connections between CPU 164 and message controller 168 is shown as connection 180. CPU 164 also acts to store the programmed information relevant to a particular fabric material selected, e.g., temperature unique to a particular type of fabric selected for ironing; steam-spray instruction commands (for sending to the message controller) unique to a particular type of fabric selected for ironing.

Message controller 168 stores pre-recorded messages, and on command from CPU 164, plays select messages back over speaker 114. The messages stored by message controller 168 may comprise any combination of sounds, e.g., jingle and/or voice messages. In some embodiments, the message comprises a voice instructing the user to: (1) not apply steam and not apply spray, (2) apply steam but no spray, (3) apply steam and spray (if necessary), and (4) apply lots of steam and lots of spray (e.g., heavy steam and heavy spray), and variations thereof. In operation, CPU 164 determines which message, if any, is to be played back by message controller 168 and sends the appropriate signal to the message controller commanding message controller 168 to reproduce the selected message. Upon receiving the signal from CPU 164, message controller 168 sends an audio signal over connection 184, which is broadcast by speaker 114.

For example, the CPU instructs the message controller to signal the speaker to broadcast the message: (1) not apply steam and not apply spray, when the following fabric selector switch is actuated: silk, acrylic, lacral/spandex, nylon, acetate, polyester, viscose, and triacetate. The CPU instructs the message controller signal the speaker broadcast the message: (2) apply steam but no spray, when the following fabric selector switch is actuated: wool. The CPU instructs the message controller signal the speaker broadcast the message: (3) apply steam and spray, when the following fabric selector switch is actuated: cotton. The CPU instructs the message controller signal the speaker broadcast the message: (4) apply lots of steam and lots of spray, when the following fabric selector switch is actuated: linen.

In some embodiments, the CPU instructs the message controller to signal the speaker to broadcast the message: (5) apply steam if necessary and not apply spray, when the following fabric selector switch is actuated: silk. One of ordinary skill would understand that it may be necessary to apply steam to silk if the silk is severely wrinkled or has a deep crease.

Of course, other additional variations of the steam-spray instructions may be provided and pre-recorded, as one of ordinary skill would deem appropriate. Also, message (1) above may be pre-recorded and presented as "Please do not steam and do not spray." Message (2) above may be pre-recorded and presented as "Please steam, but do no spray." Message (3) above may be pre-recorded and presented as "Please steam, and spray if necessary." message (4) above may be pre-recorded and presented as "Please use a lot of steam and spray."

In some embodiments, the message comprises (1) an ascending jingle, and (2) a descending jingle, and an appropriate jingle message is broadcasted when the user actuates a fabric selector switch. For example, when a fabric selector switch actuated requires the sole plate to be heated to a higher temperature, then the CPU commands the message controller to broadcast an ascending jingle (for example, a musical arrangement starting with a lower note and ending with a higher note). Alternatively, when a fabric selector switch actuated requires the sole plate to be cooled to a lower temperature, then the CPU commands the message controller to broadcast a descending jingle (for example, a musical arrangement starting with a higher note and ending with a lower note).

In some embodiments, the message comprises (1) an ascending jingle, (1.1) an ascending jingle plays for a longer duration than that of (1), (2) a descending jingle, or (2.1) a descending jingle that plays for a longer duration than that of (2). For example, when a fabric selector switch actuated requires the sole plate at a low temperature to be heated to a medium temperature, then the CPU commands the message controller to broadcast an ascending jingle. When a fabric selector switch actuated requires the sole plate at a low temperature to be heated to a high temperature, then the CPU commands the message controller to broadcast an ascending jingle with a duration that is longer than that of (1) to indicate that the degree of temperature being raised is much higher, e.g., from low to high and not low to medium. Alternatively, when a fabric selector switch actuated requires the sole plate at a high temperature to be cooled to a medium temperature, then the CPU commands the message controller to broadcast a descending jingle. When a fabric selector switch actuated requires the sole plate at a high temperature to be cooled to a low temperature, then the CPU commands the message controller to broadcast a descending jingle with a duration that is longer than that of (2) to indicate that the degree of temperature being dropped is much lower, e.g., from high to low as compared to medium to low.

In some embodiments, when a fabric selector switch is actuated which requires an increase in the temperature of the sole plate, the CPU instructs the message controller to send a signal to the speaker to broadcast a message indicating that temperature of the sole plate is being raised, e.g., "You have raised the temperature" or other variations of expression stating the same message.

In some embodiments, the CPU 164 comprises a timer to trigger the message controller to repeat that a particular fabric selector switch is actuated. For example, as shown in FIG. 1B if the user actuates the "silk" switch by turning the dial to match the arrow with the word "silk", then the iron will broadcast at every pre-determined time interval (e.g., every two seconds) with the message "You have selected silk".

In some embodiments, when a fabric selector switch is actuated, the CPU commands the heating element 300 through a connection 310 to heat up. In some embodiments, the heating element is in conductive heat contact with the sole plate to heat the sole plate (see, for example, U.S. Pat. Nos. 5,367,799 and 5,025,578, the disclosures of which are incorporated in their entirely herein by reference.) For example, when the "Acrylic" fabric selector switch is actuated (e.g., by turning the dial 4 shown in FIG. 1A to "Acrylic"), the sole plate would be heated to 135° C. (275° F.). Other particular fabric selector switch that can be actuated and the temperature to heat the sole plate to include, but not limited to: Lycra/Spandex 135° C. (275° F.), Nylon 135° C. (275° F.), acetate 143° C. (290° F.), Wool 148° C. (300° F.), Polyester 148° C. (300° F.), Silk 148° C. (300° F.), Viscose 190° C. (375° F.), Triacetate 200° C. (390° F.), Cotton 204° C. (400° F.), Linen 230° C. (445° F.).

In some embodiments, a temperature sensor 200 is in contact with the sole plate to detect the temperature of the sole plate. The temperature sensor 200 further reports the temperature of the sole plate (via the connection 210) to the CPU 164. Based upon the particular fabric selector actuated, the CPU decides if the temperature of the sole plate is appropriate. If the temperature of the sole plate is not hot enough for the particular fabric selector switch actuated, then the CPU sends a command ("second signal") via connection 310 for the heating element to heat up the sole plate. (In some embodiments, the heating element works in conjunction with a means for receiving instructions from the CPU 164, wherein upon the receipt of the instruction from the CPU 164 to turn "on" the heating element, the means triggers the heating element to heats up (e.g. allows electricity to run through a heating coil) and causes the sole plate in contact with the heating element to become hot; wherein upon receipt of instructions from the CPU 164 to turn "off" the heating element, the means causes the heating element to not be heating any more (e.g., by causing a disengagement of the power source that feeds the heating coil in the first place that causes the heat) and allow the heating element and sole plate to cool off. If the temperature of the sole plate is too hot, as reported by the temperature sensor, then the CPU would stop commanding the heating element to heat up the sole plate, and allow the sole plate to cool down over time.

One of ordinary skill can readily design an electrical schematic diagram to implement the functional block diagram of FIG. 2. See for example, FIG. 3 of U.S. Pat. No. 6,179,682 (U.S. patent application Ser. No. 09/195,786), the entire disclosure of which is incorporated in its entirety herein by reference. In some embodiments CPU 164 comprises a microprocessor manufactured by Sonix Corp. part no. SN69040M. The inputs 162 may multiplexed onto four discrete inputs P20, P21, P22, and P23 of CPU 164. CPU outputs P 4/0, P 4/1, P 4/2, and P 4/3 comprise the CPU 164 output signal 188 driving message controller 168. In some embodiments, the output signal 188 comprises a parallel four bit signal input to message controller 168.

In some embodiments, message controller 168 comprises a sound synthesis chip manufactured by Sonix Corp. part no. SN67060. Message controller 168 includes an integral memory in which a plurality of digitally coded messages may be stored. In the talking iron of the present invention, the messages stored in message controller 168 include a message to: (1) not apply steam and not apply spray, (2) apply steam but no spray, (3) apply steam and spray (if necessary), and (4) apply lots of steam and lots of spray, and variations thereof. These messages may be recorded and permanently stored in message controller 168 at the manufacturing facility prior to shipping the final product. Message controller 168 further includes an internal digital/analog ("DIA") converter coupled to analog output VO, which in turn is coupled to speaker 114.

In some embodiments, the individual messages stored in message controller 168 are selected for playback by CPU output signal 188. Signal 188 comprises a four-bit word input to message controller 168. Thus, CPU 164 can send up to sixteen commands to voice controller 168. In some embodiments, the message controller 168 is configured such that each of the sixteen commands, received via signal 188, will initiate a different function within the message controller. For example, message controller 168 may be configured such that signal 188 transmitting the binary combination 0001 may trigger the message controller to play back a message, e.g., messages: (1) not apply steam and not apply spray (e.g., "please do not steam, and do not spray"), (2) apply steam but no spray (e.g., "please steam, but do not spray"), (3) apply steam and spray (if necessary) (e.g., "please steam, and spray"), and (4) apply lots of steam and lots of spray (e.g., "please use heavy steam, and heavy spray").

Similarly, the message controller may be configured such that the combination 0101 will trigger message controller 168 to playback one of the pre-recorded jingle messages, and so forth. The preceding examples should be viewed as examples only, and should not be construed as limiting the invention in any way. The message controller may be configured such that any input combination from signal 188 may trigger any desired response. However, each pre-recorded message stored in message controller 168 will have a unique CPU output command associated therewith such that each message will be played back over analog output VO to speaker 114 in response to the proper command from CPU 164.

In some embodiments, a 5K volume control potentiometer is provided in the speaker output circuit, as is output amplifier.

Other miscellaneous circuit features of the present invention include a 4.5v battery power source. Power-on indicating power light indicator 117 is connected between the positive supply voltage Vcc and pin of message controller 168. Thus, power light indicator draws current and is illuminated when Vcc is present and message controller 168 is powered up. The electronic components and circuitry can be mounted on a printed circuit board (not shown) housed within the base of talking iron 100.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An iron being adapted to guide a user through an ironing task, the iron comprising:

a plurality of fabric selector switches, a message controller, a speaker, a temperature sensor, and a microprocessor;

said fabric selector switches are operatively connected as inputs to said microprocessor;

said temperature sensor is operatively connected to a sole plate of the iron to measure the temperature of the sole plate, and the temperature sensor is also operatively connected as inputs to said microprocessor;

said microprocessor configured to (a) receive input data from a fabric selector switch that is actuated;

(b) generate a first and second output control signals being associated with the fabric selector switch that is actuated, wherein the first output control signal is operatively connected to said message controller, such that in response a particular fabric selector switch that is actuated a pre-recorded message unique to the particular fabric selector switch that is actuated is selectively reproduced over said speaker, the message recites a steam-spray instruction unique to the fabric selector switch that is actuated, and optionally the message recites a confirmation of the fabric selector switch that is actuated, wherein the second output control signal is operatively connected to a heating element that heats a sole plate of the iron to a temperature that is pre-set for a fabric selector switch that is actuated, (c) further receive input data from the temperature sensor for the microprocessor to maintain a proper heating of the sole plate at a preset temperature for the fabric selector switch that is actuated.

2. The iron of claim 1 further comprising a power switch, wherein turning the power switch to an on position triggers the microprocessor to send a fourth signal to the message controller, wherein the speaker plays a pre-recorded message to prompt a user to determine an appropriate selection of a fabric material from the fabric selector.

3. The iron of claim 1 further comprising a power switch, wherein turning the power switch to an on position triggers the microprocessor to send a fourth signal to the message controller, wherein the speaker plays a pre-recorded message to prompt a user:

(a) to determine whether there are more than one article of clothing to be ironed, and (b) to determine an appropriate selection of a fabric material from the fabric selector.

4. The iron of claim 1 wherein the steam-spray instruction prompts a user to apply no steam and no spray.

5. The iron of claim 4 wherein the fabric selector switch actuated is for a silk material.

6. The iron of claim 1 wherein the steam-spray instruction prompts a user to apply steam and no spray.

7. The iron of claim 6 wherein the fabric selector switch actuated is for a wool material.

8. The iron of claim 1 wherein the steam-spray instruction prompts a user to apply steam and spray.

9. The iron of claim 8 wherein the fabric selector switch actuated is for a cotton material.

10. The iron of claim 1 wherein the steam-spray instruction prompts a user to apply high steam and high spray.

11. The iron of claim 10 wherein the fabric selector switch actuated is for a linen material.

* * * * *